US005209300A

United States Patent [19]

Ayres

[11] Patent Number: 5,209,300

[45] Date of Patent: May 11, 1993

[54] PRESSURE REGULATED CHEMICAL INJECTION SYSTEM

[76] Inventor: Robert N. Ayres, 142 S. Cockren's Green Cir., The Woodlands, Tex. 77383

[21] Appl. No.: 830,607

[22] Filed: Feb. 4, 1992

[51] Int. Cl.[5] ..... E21B 37/06

[52] U.S. Cl. ..... 166/305.1; 166/90; 166/902

[58] Field of Search ..... 166/305.1, 307, 75.1, 166/90, 902, 91, 53

[56] References Cited

U.S. PATENT DOCUMENTS

| | | | |
|---|---|---|---|
| 1,645,686 | 10/1927 | Brady . | |
| 2,752,067 | 6/1956 | Vohl et al. | 222/811.5 |
| 2,801,697 | 8/1957 | Rohrback | 166/1 |
| 2,884,067 | 4/1959 | Marken | 166/75 |
| 3,228,472 | 1/1966 | Rhoads, Jr. | 166/902 X |
| 3,700,031 | 10/1972 | Germer, Jr. et al. | 166/273 X |
| 4,390,061 | 6/1983 | Short | 166/75.1 X |
| 4,436,148 | 3/1984 | Maxwell | 166/53 |
| 4,582,131 | 4/1986 | Plummer et al. | 166/68 |
| 4,593,763 | 6/1986 | Burke | 166/302 |
| 4,796,697 | 1/1989 | Ayres | 166/310 |
| 4,830,112 | 5/1989 | Erickson | 166/304 |
| 4,896,726 | 1/1990 | Ayres | 166/312 |

OTHER PUBLICATIONS

Containment Incorporated, "Spilguard System 55 & System 80".

*Primary Examiner*—William P. Neuder

[57] ABSTRACT

An apparatus and method for injecting chemicals into a hydrocarbon producing well is disclosed. The invention includes a vessel which holds the chemical and a pressurized gas which exerts a pressure on the chemical. A pressure regulator and a valve selectively control the injection of the chemical into the well as the pressurized gas urges the chemical out of the vessel. The pressurized gas drives the chemical through the regulator, valve, and into the well without venting the chemical or pressurized gas into the ambient environment.

20 Claims, 1 Drawing Sheet

PRESSURE REGULATED CHEMICAL INJECTION SYSTEM

FIELD OF THE INVENTION

The present invention relates to an improved apparatus and method for injecting chemicals into a hydrocarbon producing well. More particularly, the present invention relates to a pressure vessel which contains the chemical and a pressurized gas which urges the chemical from the vessel and into the hydrocarbon producing well.

BACKGROUND OF THE INVENTION

In the production of oil, gas and other hydrocarbons, a tubing string is often positioned within the well casing. The hydrocarbons enter the tubing through perforations located at the lower end of a tubing string. In some wells, the hydrocarbons are pumped to the surface with a sucker rod pump located on the surface or with a downhole submersible pump. At the well surface, production equipment directs the hydrocarbon fluids to holding tanks or to a pipeline. The well production equipment typically comprises tubing, valves, piping, and other components.

The hydrocarbon fluids contain numerous compounds which adversely affect the well production equipment. For example, paraffins and water/oil emulsions can coat well production equipment and eventually plug perforations in the tubing. In addition, chemical reactions between the hydrocarbon fluids and metallic equipment can cause scale to be formed on the well production equipment, and corrosive compounds in the hydrocarbon fluids can physically corrode the well production equipment.

Various techniques can treat these well conditions to extend the useful life of the well production equipment. In wells susceptible to paraffin build-up, "treater trucks" are regularly dispatched to pump hot oil into the well. The hot oil enters the casing, melts the paraffin deposits in the well production equipment, and returns to the surface through the tubing. For wells susceptible to corrosion and scale problems, high pressure injection trucks pump batches of chemicals into the well to chemically remove the scale, and to inhibit the causes of corrosion. All of these practices require regular maintenance services which are costly and which do no continuously treat the well. Batch treatment of wells is less efficient that continuous treatments because more chemicals are typically injected in batch treatment operations.

To avoid inefficiences associated with treater truck maintenance of hydrocarbon producing wells, well operators use mechanical pumps to inject chemicals into a well. Typically, mechanical pumps are supplied from a storage tank which holds the chemicals. The mechanical pumps and storage tanks are located adjacent the well for several reasons, such as for reduicng the length of the power cable connected to the pump. The tanks are located above the pump and the chemical is gravity fed to the intake port of the pump. These tanks include a vent at the upper end of the tank to prevent a vacuum from developing in the tank as the pump draws chemical from the tank. In addition, the vent releases excess pressure within the tank caused by thermal expansion of the chemical. Such thermal expansion can cause the chemical vapors to be released into the environment through the vent. In addition, thermal expansion can cause the chemical to be ejected through the vent or through the sight glass used to indicate the chemical level in the tank. In either event, chemical vapors or the chemical fluids are released in an uncontrolled manner and can pose a hazard to personnel and to the environment.

The mechanical pumps used in chemical injection systems are powered by electricity or gas and include numerous moving components. It is customary to inspect these pumps on a regular basis, sometimes daily, to verify the operability of the pumps. Because the chemical is gravity fed to the intake of the chemical pump, sediment in the tank or the chemical settles toward the pump intake and can interfere with the operation of the pump In addition, the presence of an air bubble in the intake line may impede the operation of the pump because of a vapor lock. In such event, maintenance personnel routinely open a bleeder valve on the pump and release chemical from the pump until the air bubble has been cleared. This practice is undesirable because it releases chemical into the environment.

Presently available systems contain moving components which are subject to failure and require regular maintenance. Such systems are also undesirable because they vent chemicals into the environment. Accordingly, a need exists for a system which injects chemicals into a hydrocarbon producing well without moving components and without releasing the chemicals into the environment.

SUMMARY OF THE INVENTION

The present invention overcomes the limitations of the prior art by disclosing a closed system which can inject chemicals into a hydrocarbon producing well without using moving components. The invention includes a vessel for containing the chemical and a pressurized gas within the vessel for pressurizing the chemical. An outlet is attached to the vessel for permitting the chemical to exit the vessel. A pressure regulator and a valve are connected in fluid communication between the vessel and the well to selectively control the flow of chemical into the well. The pressure regulator controls the differential pressure acting on the valve between the vessel and the well, and the valve is operable to control the flow of chemical as the pressurized gas causes the chemical to exit the vessel. The method of the invention comprises the steps of placing a pressurized gas into the vessel, and of injecting the chemical into the vessel so that the pressurized gas exerts a pressure on the chemical. The valve is operated to selectively control the flow of chemical from the vessel and into the well.

DESCRIPTION OF THE PREFERRED EMBODIMENTS

Figure 1:
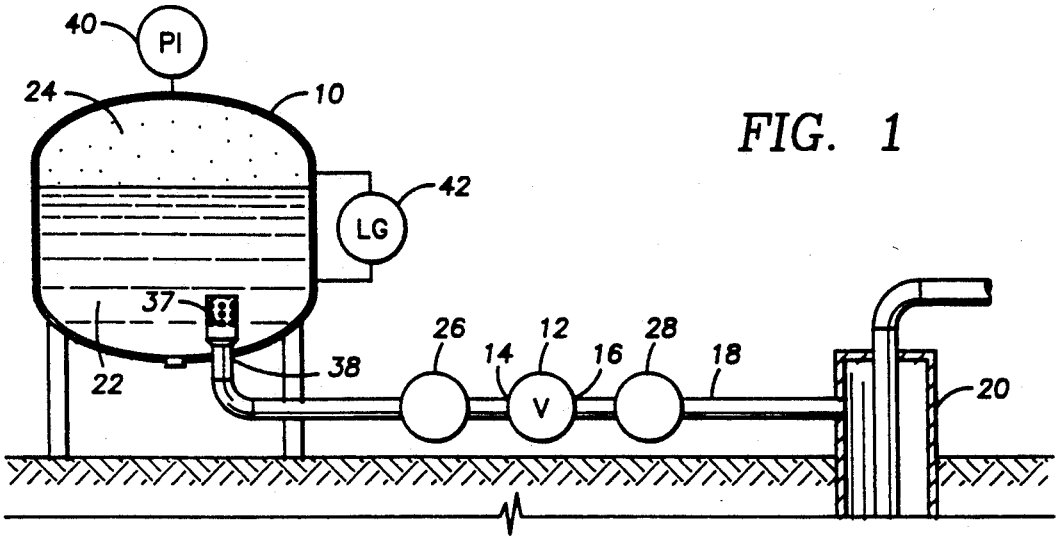
FIG. 1 illustrates a schematic view of a vessel containing a chemical and a pressurized gas, wherein a pressure regulator is located in fluid communication between the vessel and the valve.

The present invention overcomes the limitations of the prior art by disclosing a unique apparatus and method for injecting a chemical into a hydrocarbon producing well. Referring to FIG. 1, vessel 10 comprises a container which is capable of holding an internal pressure without failure. Vessel 10 is distinguishable from containers such as tanks which are only designed to withstand the hydrostatic presure exerted by the fluid in the tank. Preferably, vessel 10 is constructed from a fiberglass, stainless steel, epoxy resin, or other material which is resistant to degradation induced by chemicals and corrosive gases. Alternatively, vessel 10 can be constructed from a material which is coated with an inner lining (not shown) resistant to corrosion.

Valve 12 is attached to the lower end of vessel 10 and has an inlet end 14 in fluid communication with vessel 10. Valve 12 can comprise a micrometering valve which is adjustable to increase or decrease the flow rate. Outlet end 16 of valve 12 is connected to one end of fluid line 18, and the other end of fluid line 18 is attached to hydrocarbon producing well 20. In another embodiment, fluid line 18 is connected between vessel 10 and well 20, and valve 12 is in fluid communication with fluid line 18. A filter (not shown) can be installed in line 18 to prevent solid particles in chemical 22 from contaminating valve 12. In another embodiment, line 18 can be connected to the lower end of vessel 10 and can rise upwards so that gravity acts against solid particles in chemical 22 to prevent the solid particles from entering valve 12.

Although well 20 can comprise a hydrocarbon producing well, the present invention is useful in other wells relating to the production of hydrocarbons such as injection wells used in enhanced recovery operations. As used throughout this disclosure, the terms "well" and "hydrocarbon producing well" will include all wells directly or incidentally associated with the production or injection of fluids containing hydrocarbons.

Chemical 22 is contained in vessel 10 in liquid form. As contemplated by the present invention, chemical 22 can comprise any liquid compound or material to be injected into a hydrocarbon producing well. As representative examples, without limiting the scope of the invention, chemical 22 can comprise chemicals generally identified as scale inhibitors, water clarifiers, demulsifiers, and other chemicals which inhibit the formation of chemical, organic, or metallic compounds in hydrocarbon producing wells.

As shown in FIG. 1, pressurized gas 24 is also located in vessel 10. Pressurized gas 24 preferably comprises a gas which does not chemically react with chemical 22, and may comprise readily available gases such as nitrogen, helium, argon or carbon dioxide. Pressurized gas 24 is initially retained at a pressure which is less than the liquification pressure for such gas. These liquification pressures are commonly known for each gas, and are not exceeded within vessel 10 to prevent the mixing of pressurized gas 24 with chemical 22. In addition, the density of pressurized gas 24 is preferably less than the density of chemical 22 so that chemical 22 is concentrated toward the lower end of vessel 10, and pressurized gas 24 is concentrated toward the upper end of vessel 10. As shown in FIG. 1, pressurized gas 24 is in contact with chemical 2 and pressurizes chemical 22 to the same pressure as that of pressurized gas 24.

As shown in FIG. 1, pressure regulator 26 is installed between vessel 10 and inlet 14 of valve 12. Regulator 26 controls the pressure of chemical 22 which is in contact with valve 12. For example, if the pressure of pressurized gas 24 and chemical 22 in vessel 10 is 500 psi, regulator 26 can reduce the pressure of chemical 22 in contact with valve 12 to a desired pressure greater than the well pressure. As a representative example, if the pressure of well 20 was 90 psi, and the desired pressure differential across valve 12 was 10 psi, regulator 26 could reduce the pressure of chemical 22 from 500 psi to 100 psi. Regulator 26 should not reduce the pressure of chemical 22 below the pressure in well 20 because this event would cause fluids in the well to enter fluid line 18 and valve 12. To prevent the accidental or inadvertent backflow of well fluids into fluid line 18, check valve 28 can be installed in line 18.

The control of the pressure differential across valve 12 is important because the flow rate through certain types of valves is dependent on the size of the valve orifice and the pressure differential between the valve inlet and outlet ports. As the pressure differential across a valve increases, the flow rate through the valve will typically increase unless the valve is designed to maintain a steady flow rate in response to varying flow pressures. As steady rate valves are more expensive than other valves which do not have a pressure compensation feature, pressure regulator 26 is an inexpensive solution for controlling the flow rate of chemical through valve 12. Regulator 12 is also useful because the use of regulator 12 in conjunction with valve 12 permits the precise control of small quantities of chemical 22. Since the flow rate through a valve is usually an inverse function of the pressure differential acting across the valve, and the size of the valve aperture, high differential pressures such as 500 psi would force a large quantity of chemical through the valve unless the valve aperture was extremely small. Limiting the flow rate of chemical through a valve to quantities less than one gallon would be difficult without the use of a valve specicially designed for such purpose. The present invention overcomes this problem by using regulator 26 to control the differential pressure acting across valve 12. This feature permits the selective control of relatively small chemical flow rates through valve 12.

Figure 2:
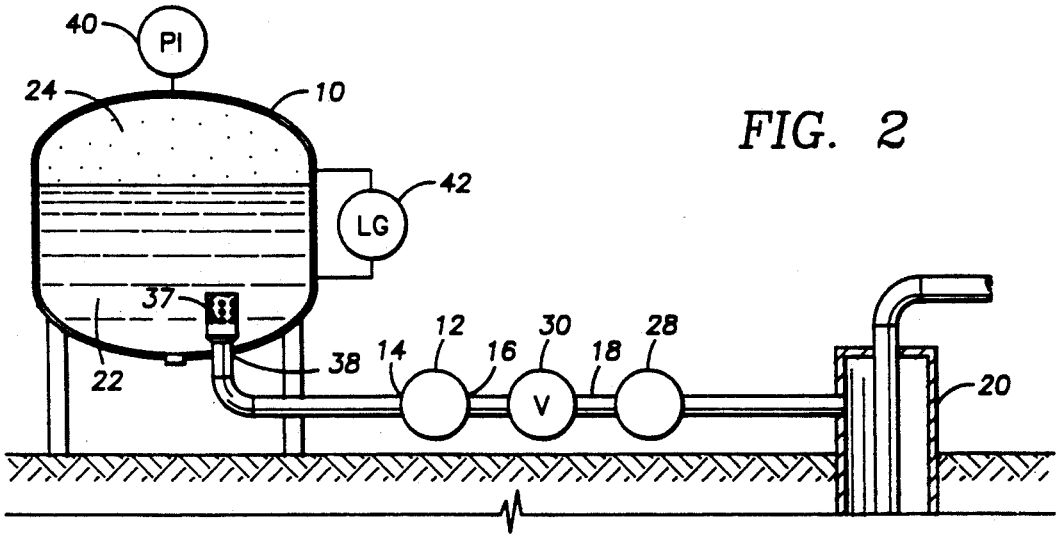
FIG. 2 illustrates a schematic view of a vessel containing a chemical and a pressurized gas, wherein a pressure regulator is located in fluid communication between the valve and the well.

FIG. 2 illustrates another embodiment of the present invention, wherein pressure regulator 30 is located in line 18 between valve 12 and well 20. In this embodiment, regulator controls the pressure differential across valve 12 as described in the embodiment illustrated in FIG. 1. This embodiment differs from the embodiment shown in FIG. 1 in several respects. For example, as chemical 22 exits vessel 10 and is injected into well 20, the volume of pressurized gas 24 expands within vessel 10. Because the pressure of a gas is inversely proportional to the volumn it occupies, the pressure of pressurized gas 24, and that of chemical 22, will decrease as chemical 22 exits vessel 10. If regulator 30 permits chemical 22 to flow into well 20 at a fixed pressure, the pressure differential acting across valve 12 will decrease as the pressure of pressurized gas 24 decreases. This variance in pressure may change the flow rate of chemical 22 through valve 12 unless valve 12 is specifically designed to adjust for such variations. Although the variations in the chemical pressure in vessel 10 may not materially change the flow rate of chemical 22 through valve 12, the embodiment illustrated in FIG. 1 is not affected by this factor. Regulator 30 does prevent variations in the fluid pressure of well 20 from affecting the differential pressure acting across valve 12. In this capacity, regulator 30 can serve the additional function of check valve 28 by preventing irregularly high fluid pressures in well 20 from backflowing into valve 12.

Figure 3:
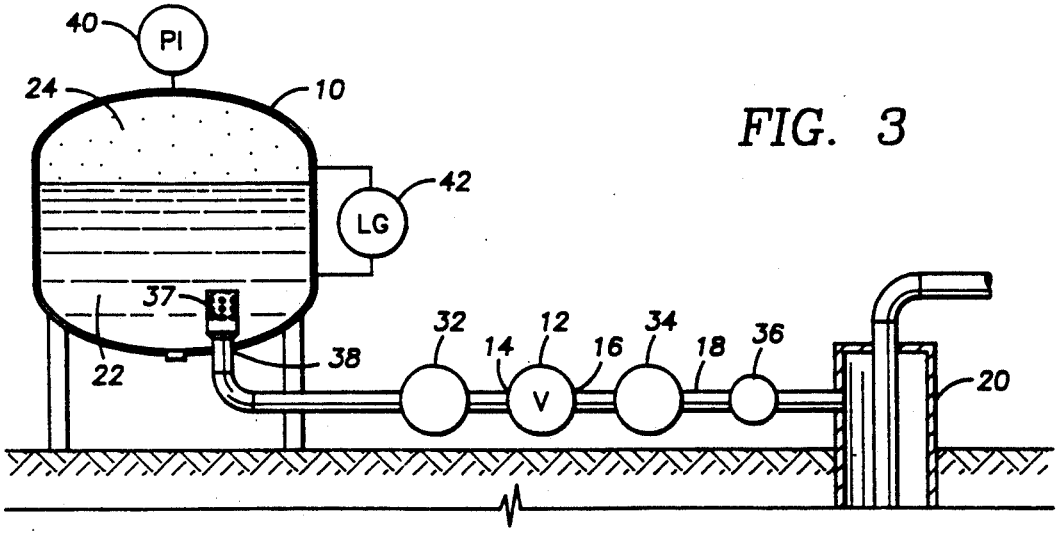
FIG. 3 illustrates a schematic view of a vessel containing a chemical and a pressurized gas, wherein a first pressure regulator is located between the vessel and the valve, and a second pressure regulator is located between the valve and the well.

Referring to FIG. 3, first regulator 32 is located between vessel 10 and valve 12, and second regulator 34 is located between valve 12 and well 20. Valve 12, first regulator 32, and second regulator 34 are each in fluid communication with vessel 10 and well 20. In this embodiment, pressure fluctuations in vessel 10 and in well 20 are isolated from valve 12. Consequently, the pressure differential acting across valve 12 can be precisely controlled, thereby permitting effective control over the flow rate of chemical 22 through valve 12. This embodiment permits the flow rate of chemical 22 to be reduced to a constant rate substantially less than one gallon per day. This innovation is desirable because relatively small quantities of chemical may be sufficient to accomplish the desired treatment of well 20 and additional chemical injections merely represent an unnecessary cost to the well operator. In other embodiments of the invention, the function of regulators 32 and 34 may be accomplished with a valve configuration which precisely meters small flow quantities and is not affected by variations in the pressures acting on either inlet 14 or outlet 16 of valve 12.

In operation, and referring to Figure 1, valve 12 is initially closed to prevent the release of chemical 22 from vessel 10. Valve 12 is then selectively opened and pressurized gas 24 urges chemical 22 through regulator 24, valve 12, line 18, and into well 20. Preferably, valve 12 is adjustable to selectively control the flow of chemical 22 into well 20. Valve 12 can be adjusted to selectively increase or decrease the flow rate of chemical 22 into well 20. This feature is a important feature of the present invention, since the precise injection rate of chemical 22 accomplishes several objectives. Certain wells require large volumes of chemicals to accomplish the desired function. Other wells require only relatively small quantities of chemicals to accomplish the desired results. For example, certain wells may require only a fraction of a gallon per day to accomplish the desired result, and the injection of additional chemicals is unnecessary to the operation of the well. If more chemical than required is injected into the well, then the excess chemical is superfluous to the operation of the well and results in additional cost to the operator. The present invention selectively controls the flow rate of the chemical and eliminates unnecessary chemical consumption.

The present invention can be adjusted to control the flow of chemical in several different ways. In one embodiment of the invention, valve 12 continuously permits chemical 22 to exit vessel 10 and to enter well 20. In another embodiment, valve 12 can be configured to selectively permit a selected quantity, or batch, of chemical 22 into well 20. This batch feature can be accomplished by a timer mechanism (not shown) or mechanical device incorporated into valve 12 through techniques well-known in the art. Although batch treating of chemicals into well 20 may be desired in certain applications, the capability to continuously feed chemicals into well 20 without using pumps will improve the performance of certain chemical treatments over the batch treatments known in the art. In certain applications, this continuous treatment will prevent the occurance of corrosion or paraffin buildup before the corrosion or paraffin buildup begins to affect the performance of the downhole well equipment. This advantage is not presently realized by batch treatments because the chemicals are only injected during a small period of time relative to the total operation of the well.

Referring to FIG. 3, check valve 36 is installed in line 18 to prevent the backflow of fluids in well 20 from flowing into valve 12 or vessel 10. This feature is desirable because a well operator could accidentally pressurize well 20 to a pressure higher than that of chemical 22 in vessel 10. Alternatively, this function could be incorporated into the design of valve 12 as previously described. In addition, chemical inlet 28 is located in vessel 10 to permit the injection of chemical 22 into vessel 10. During such refilling, chemical 22 should be injected under pressure into vessel 10. This injection under pressure is necessary to overcome the pressure exerted by pressurized gas 24. Preferably, chemical 22 should be injected into vessel 10 under a pressure which is greater that the pressure of pressurized gas 24, but is less than the liquification pressure of pressurized gas 24. If the liquification pressure is exceeded, the the injection of chemical 22 into vessel 10 would cause pressurized gas 24 to liquify. The liquified gas could mix with or react with chemical 22 in an undesirable fashion.

Float or similar means 37 is located in vessel 10 to prevent pressurized gas 24 from exiting vessel 10. In one embodiment of the invention, float 37 has a density less than that of chemical 22 and is buoyant therein. As the level of chemical 22 is lowered in vessel 10 by releasing chemical 22 through valve 12, float 37 will be lowered in vessel 10. When float 37 reaches a selected position within vessel 10, at a point when the level of chemical 22 is low within vessel 10, float 37 seals outlet 38 of vessel 10 to prevent the release of pressurized gas into valve 12. This function can be accomplished in other ways other than by using float 37. For example, a sight glass (not shown) could be used to indicate the level of chemical 22 within vessel 10 so that an operator could visually check the level of chemical 22. In other embodiments, mechanical, electrical, or electronic equipment could be utilized to indicate the level of chemical 22 within vessel 10 or, alternatively, to seal outlet 38 when the level of chemical 22 is lowered to a certain position.

Pressure guage 40 is attached to vessel 10 to measure the pressure of pressurized gas 24. Guage 42 is attached to vessel 10 for measuring the quantity of chemical 22 in vessel 10. Guage 42 can comprise many different embodiments such as sight glasses, electromagnetic switches, and other devices well-known in the art. In addition, guage 42 could comprise a flow meter which measures the quantity of fluid flowing from vessel 10 When the fluid quantity flowing from vessel 10 is compared to the quantity of chemical 22 installed in vessel 10, the quantity of chemical 22 in vessel 22 at any point in time can be determined.

The present invention provides a novel method of injecting chemical into a hydrocarbon producing well. The invention controls the rate of chemical injection and can be adjusted to inject chemicals at large or small flow rates. The chemical is injected without the need for pumps or other mechanical devices which require maintenance and are subject to operational failure. The invention uniquely prevents the discharge of the chemical or pressurized gas into the environment by disclosing a closed injection system which does not require vents and does not permit chemical releases into the environment. Because the system is closed, aromatic compounds in the chemical are not vented to the environment. The absence of a vent further reduces the risk of fires due to flammable chemicals and reduces the contact between chemical vapors and well personnel. Moreover, the invention permits the continuous injection of chemicals into the well on a fulltime basis, and thereby prevents corrosion or undesirable deposits from accumulating in the well.

The present invention is particularly useful in remote or environmentally hostile regions. The absence of moving components reduces the maintenence required for the chemical injection system, in contrast to the regular care necessary for chemical pumps. Because the chemical is pressurized within the vessel, pressure changes in the chemical due to variations in the ambient temperature will be less significant than if the chemical was contained by an unpressurized storage tank. Consequently, the present invention is readily adaptable to offshore, arctic and tropical environments. In offshore platforms, the invention furnishes significant flexibility in the deck location of the vessel. In arctic environments subject to intense cold, antifreeze can be blended with the chemical to prevent icing in the valve, pressure regulator, and flow lines. In arctic or tropical environments, it may be desirable to insulate certain components of the invention to minimize the effects of temperature extremes. The pressurized gas can further be used to automatically inflate balloons or markers connected to a vessel for supporting a vessel displaced into the water from an offshore platform, or for identifying the location of the vessel after it has been otherwise displaced from a well site.

The embodiments of the invention shown herein are illustrative only, are made for the purpose of describing certain embodiments of the invention, and do not limit the scope of the invention. It will be appreciated that numerous modifications and improvements may be made to the inventive concepts herein without departing from the scope of the invention.

What is claimed is:

1. An apparatus for selectively injecting a chemical into a well, comprising:

a pressure vessel for containing the chemical, wherein said pressure vessel is closed to atmospheric pressure;

an outlet attached to said pressure vessel for permitting the chemical to exit said pressure vessel;

a valve in fluid communication with said outlet for selectively controlling the flow of chemical from said pressure vessel;

a pressure regulator in fluid communication with said chemical downstream of said outlet for controlling the pressure of the chemical; and a pressurized gas located in said pressure vessel, wherein the pressure exerted by said pressurized gas caused the chemical to flow from said pressure vessel to the well through said pressure regulator and said valve.

2. An apparatus as recited in claim 1, wherein said pressure regulator is located between said outlet and said valve for controlling the pressure of the chemical before the chemical contacts said valve.

3. An apparatus as recited in claim 1, wherein said pressure regulator is located between said valve and the well for controlling the pressure of the chemical after the chemical contacts said valve.

4. An apparatus as recited in claim 1, further comprising means for sealing said outlet to prevent said pressurized gas from exiting said pressure vessel.

5. An apparatus as recited in claim 1, further comprising a guage for indicating the quantity of the chemical in said pressure vessel.

6. An apparatus as recited in claim 1, further comprising a pressure guage attached to said pressure vessel for measuring the pressure of said pressurized gas in said pressure vessel.

7. An apparatus as recited in claim 1, wherein said valve and pressure regulator control the flow of the chemical to more than one well.

8. An apparatus as recited in claim 1, further comprising means for injecting chemical into said pressure vessel.

9. An apparatus for selectively injecting a chemical into a well, comprising:

a pressure vessel for containing the chemical, wherein said pressure vessel is closed to atmospheric pressure;

an outlet attached to said vessel for permitting the chemical to exit said pressure vessel;

a first pressure regulator in fluid communication with said outlet for controlling the chemical pressure as the chemical exits the pressure vessel;

a valve in fluid communication with said first pressure regulator for selectively controlling the flow of the chemical;

a second pressure regulator in fluid communication with said valve and the well for controlling the chemical pressure as the chemical exits said valve; and a pressurized gas located in said pressure vessel, wherein the pressure exerted by said pressurized gas causes the chemical to exit said pressure vessel through said outlet and to flow through said first pressure regulator, said valve, said second pressure regulator, and to enter the well.

10. An apparatus as recited in claim 9, further comprising means for sealing said outlet to prevent said pressurized gas from exiting said pressure vessel.

11. An apparatus as recited in claim 9, further comprising a filter for removing solids from said chemical before said chemical contacts said valve.

12. An apparatus as recited in claim 9, further comprising means for indicating the level of the chemical within said pressure vessel.

13. An apparatus as recited in claim 9, further comprising means for indicating the pressure of said pressurized gas.

14. An apparatus as recited in claim 9, further comprising means for injecting the chemical into at least two wells.

15. A method for injecting a chemical into a well, comprising the steps of:

placing a pressurized gas into a pressure vessel which is closed to atmospheric pressure;

injecting a quantity of chemical into the pressure vessel so that the pressurized gas exerts a pressure on the chemical;

operating a valve in fluid communication with the chemical for selectively controlling the flow of fluid from said pressure vessel; and operating a pressure regulator in fluid communication with the chemical to control the presure of the chemical.

16. A method as recited in claim 15, further comprising the step of adjusting said valve to change the flow rate of chemical from said pressure vessel.

17. A method as recited in claim 15, further comprising the step of measuring the quantity of the chemical within said pressure vessel.

18. A method as recited in claim 15, further comprising the step of measuring the pressure of said pressurized gas within said pressure vessel.

19. A method as recited in claim 15, wherein said valve continuously permits the chemical to exit said pressure vessel and to enter the well.

20. A method as recited in claim 15, further comprising the step of simultaneously injecting the chemical into at least two wells.

* * * * *